US008146501B1

(12) United States Patent
Fu

(10) Patent No.: US 8,146,501 B1
(45) **Date of Patent: *Apr. 3, 2012**

(54) SUPERCAVITATING PROJECTILE HAVING A MORPHABLE NOSE

(75) Inventor: Jyun-Horng Fu, Centreville, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 157 days.

This patent is subject to a terminal disclaimer.

(21) Appl. No.: 12/397,182

(22) Filed: Mar. 3, 2009

Related U.S. Application Data

(60) Provisional application No. 61/033,418, filed on Mar. 3, 2008.

(51) Int. Cl.
*F42B 15/22* (2006.01)

(52) U.S. Cl. ..... 102/399; 114/20.1

(58) Field of Classification Search ..... 102/398, 102/399, 517, 519; 114/20.1
See application file for complete search history.

(56) References Cited

U.S. PATENT DOCUMENTS

| | | | | |
|---|---|---|---|---|
| 3,041,992 | A * | 7/1962 | Lee | 114/312 |
| 3,256,816 | A * | 6/1966 | Pilcher, II | 102/374 |
| 3,282,216 | A * | 11/1966 | Calfee et al. | 244/159.1 |
| 3,842,741 | A * | 10/1974 | Brothers et al. | 102/490 |
| 4,770,369 | A * | 9/1988 | Flock et al. | 244/3.1 |
| 5,464,172 | A * | 11/1995 | Jensen et al. | 244/3.1 |
| H001938 | H * | 2/2001 | Harkins et al. | 102/399 |
| 6,388,184 | B1 * | 5/2002 | Glenning | 114/22 |
| 6,739,266 | B1 * | 5/2004 | Castano et al. | 102/399 |
| 7,779,759 | B2 * | 8/2010 | Paulic et al. | 102/399 |
| 7,874,251 | B1 * | 1/2011 | Fu | 102/399 |

* cited by examiner

*Primary Examiner* — Bret Hayes
(74) *Attorney, Agent, or Firm* — DeMont & Breyer, LLC

(57) ABSTRACT

A supercavitating projectile having a nose that is capable of morphing its shape or length for extended operating range is disclosed.

15 Claims, 8 Drawing Sheets

To maximize supercavitation range, morph nose from 26.6° thru 45° to 90° (half-angle of the cone)

Parametric curves show various values of $d_b/d_n$

In low-speed regime, continuously flatten the nose cone as it decelerates and set $d_b/d_n$ to 3

SUPERCAVITATING PROJECTILE HAVING A MORPHABLE NOSE

STATEMENT OF RELATED CASES

This case claims priority of U.S. Provisional Patent Application 61/033,418, which was filed Mar. 3, 2008 and is incorporated herein by reference.

FIELD OF THE INVENTION

The present invention relates to supercavitating projectiles.

BACKGROUND OF THE INVENTION

Cavitation is a general term used to describe the behavior of voids or bubbles in a liquid. Cavitation occurs when water pressure is lowered below its vapor pressure or vapor pressure is increased to water pressure. When this happens, the water vaporizes, typically forming small bubbles of water vapor. But these bubbles of water vapor are typically not sustainable. Rather, the bubbles collapse, and when they do, they force liquid energy to very small volumes. This results in localized high temperature and the generation of shock waves.

Cavitation is ordinarily an unintended and often undesirable phenomenon. The collapse of small bubbles produces great wear on pump components and can dramatically shorten the useful life of a propeller or pump. It also causes a great deal of noise, vibration, and a loss of efficiency.

But the phenomenon of cavitation is not always undesirable; an exception is the phenomenon of "supercavitation." During supercavitation, a sustainable bubble of gas 102 inside a liquid 100 is created by the blunt forward surface 116 of nose (cavitator) 106 of moving object 104, as depicted in FIG. 1. Bubble 102 envelopes the entire moving object, except for forward surface 116, with the result that the drag experienced by the moving object is significantly reduced. As a consequence, a supercavitating object can travel at far greater speeds for a given amount of thrust than an object that is moving in a conventional manner through water. It is also well known that supercavitation enhances motion stability of an object as well.

A supercavitating object's main features are a specially shaped (blunt) nose and a streamlined, hydrodynamic, and aerodynamic body. When the object is traveling through water at speeds in excess of about one hundred miles per hour, the blunt nose deflects the water outward so fast that the water flow separates and detaches from the surface of the moving object. Since water pressure takes time to collapse the wall of the resulting cavity, the nose opens an extended bubble of water vapor. Given sufficient speed, the cavity can extend to envelop the entire body of the object. A supercavitating object quite literally 'flies' through the surrounding gas. In the absence of sustaining propulsion, the moving object loses supercavitation and eventually stalls due to drag.

SUMMARY OF THE INVENTION

The present invention provides an improved design and an improved method of operating a supercavitating projectile that avoids some of the drawbacks of the prior art.

It is desirable to maintain supercavitating operation for as long as possible, thereby extending the range of a supercavitating projectile. In accordance with the illustrative embodiment of the present invention, the range of a supercavitating projectile is extended by providing a "nose" that is capable of morphing (shape or length) during supercavitating operation.

Nose Shape. Supercavitation range can be expressed in terms of the drag coefficient and the supercavitation velocity. The present inventor recognized that supercavitation velocity is an indirect function of nose shape. Furthermore, the present inventor recognized supercavitation velocity to be an implicit function of the drag coefficient, which depends on the nose shape. Expressions relating the shape of a projectile's nose to the projectile's range are derived and provide a design and operational methodology for maximizing the range of a supercavitating projectile. Nose shape can be altered through the use of piezo-electric elements or other arrangements. After reading the present disclosure, those skilled in the art will be able to design and build arrangements for altering nose shape.

Nose Length. At various locations along its length, a projectile intended for supercavitating operation might have projections, such as canard wings, extending radially from its main body. As a consequence, if the supercavitating cavity is not wide enough, these protrusions will "clip" the perimeter of the cavity, resulting in loss of supercavitation. Furthermore, in situations in which the projectile accelerates from rest under water to attain supercavitation, it is desirable for the growing cavity to experience as little clipping as possible.

The cavity formed via supercavitation is generally ellipsoid; therefore, the cavity is narrowest at the antipodal points along the main axis. The present inventor recognized that lengthening the nose of the projectile will have the effect of shifting the cavity "forward" relative to the main body of the projectile, so that the widest parts of the projectile (e.g., radially-extending appendages such as canards, etc) will tend to be positioned within the wider parts of the cavity. This will decrease the likelihood of cavity clipping and the consequential loss of supercavitation, whether due to the presence of radially-extending appendages or during acceleration from rest.

Notwithstanding the foregoing, a projectile having a longer overall length (e.g., due to a longer nose, etc.) will generally experience loss of supercavitation before a relatively shorter projectile. The reason is that the minimum velocity for maintaining supercavitation increases with increasing projectile length. Therefore, other factors being equal, once thrust is lost, a velocity of relatively longer projectile will fall below the minimum velocity for sustaining supercavitation before a relatively shorter projectile.

The inventor recognized that the foregoing issue can be addressed by providing a projectile having an adjustable nose length.

In some embodiments, the length of the nose is changed electrically using, for example, a stepper motor. In some other embodiments, the length of the nose is changed magnetically. In still further embodiments, the length of the nose is changed hydraulically. In conjunction with the present disclosure, those skilled in the art will be able to design and implement electrically, magnetically, and hydraulically actuated arrangements for adjusting nose length. Since the nose faces the flow (i.e., experiences drag), in some embodiments, thrust is throttled to change the length of the nose. In such embodiments, the nose is structured to slide relative to the main body of the projectile.

DETAILED DESCRIPTION

Figure 1:
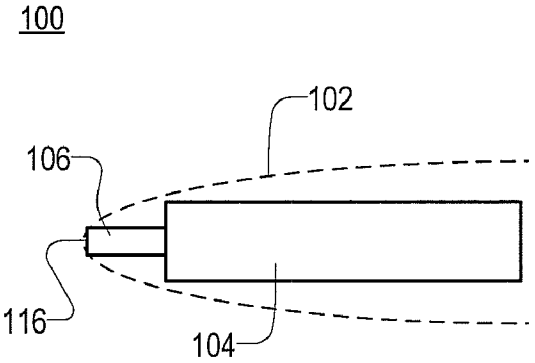
FIG. 1 depicts a projectile in supercavitating operation in conventional fashion.

Nose Shape. Expression [1] provides the range, R, of a supercavitating projectile where the nose thereof is a right circular cylinder:

$$R = \frac{1}{2K}\ln\left(\frac{V_0^2 + V_c^2}{V_{sc}^2 + V_c^2}\right) \quad [1]$$

Where:

$V_o$ is initial velocity;

$V_c$ is the characteristic velocity=$(2P/\rho_w)^{0.5}$;

P is the static drag;

$\rho_w$ is the density of the water at the relevant temperature;

$V_{sc}$ is the velocity for supercavitation=$(d_b/d_n-\delta_0)/\delta_1$;

$d_b$ is the diameter of the body of the projectile;

$d_o$ is the diameter of the nose of the projectile;

$\delta_0$ is an empirically-determined constant=0.213387;

$\delta_1$ is an empirically-determined constant=0.910052;

$K=(\Pi/8m)\times\rho d_n^2 C_{d0}$;

m is the mass of the projectile; and $C_{d0}$ is the drag coefficient under supercavitation.

Expression [2] provides the range, R, of a supercavitating projectile where the nose thereof has an arbitrary shape:

$$R = \lambda d^2 \ln\left(\frac{v_0^2 + 1}{v_{sc}^2 + 1}\right) = \lambda d^2[\ln(v_0^2 + 1) - \ln(v_{sc}^2 + 1)] \quad [2]$$

Where:

d is the ratio $d_b/d_n$;

$\lambda=(4/\pi)[m/(\rho_w d_b^2 C_{d0})$

In expression [2], a different drag coefficient would be used and $V_{sc}$ will be different. To find the maximum of expression [2], its first derivative is obtained and equated to zero:

$$\ln\left(\frac{v_0^2 + 1}{v_{sc}^2 + 1}\right) - \frac{v_{sc}(v_{sc} + \Delta)}{v_{sc}^2 + 1} = 0 \quad [3]$$

Where: Δ is $\delta_0/\delta_1$

Expression [4] provides the expression for range, R, rewritten in a form that is easier to solve than the form that appears in expressions [2] and [3].

$$f(v_{sc}) = (v_{sc}^2 + 1)\exp\left[\frac{v_{sc}(v_{sc} + \Delta)}{v_{sc}^2 + 1}\right] - (v_0^2 + 1) = 0 \quad [4]$$

The expression $f'(V_{sc})$ is the derivative of $f(V_{sc})$, as required to use Newton's method:

$$f'(v_{sc}) = (v_{sc}^2 + 1)\exp\left[\frac{v_{sc}(v_{sc} + \Delta)}{v_{sc}^2 + 1}\right]\left\{4v_{sc} + \Delta - \frac{2v_{sc}\cdot v_{sc}(v_{sc} + \Delta)}{v_{sc}^2 + 1}\right\} \quad [5]$$

$$\text{Newtown's method: } x_{n+1} = x_n - \frac{f(x_n)}{f'(x_n)} \quad [6]$$

$V_{sc}\sim V_o/2$ is an initial guess for use with Newton's method, wherein $V_o$ is initial velocity.

Expression [7] provides $(d_b/d_n)^*$, which, for optimizing supercavitating range, R, is the theoretical optimal value for the ratio $d_b/d_n$, which is the ratio of body diameter to the nose diameter of the supercavitating projectile:

$$(d_b/d_n)^* \approx 0.550783(V_0/V_c)+0.157122 \quad [7]$$

Where: $V_0/V_c$ is initial velocity normalized to characteristic velocity (dimensionless).

A projectile being launched from air into the water (e.g., from the deck of a ship, etc.) must, of course, survive water entry. Of particular concern is the ability of the projectile's nose to withstand the initial impact with water. This implicates design considerations (e.g., the manner in which the nose couples to the body of the projectile, etc.) as well as a minimum diameter, for the nose, based on materials of construction. Projectile designs based on expression [7] cannot, therefore, be used without regard to a minimum nose diameter. Those skilled in the art will be able to determine a minimum diameter from first principles or simple experimentation.

Expressions [8] and [9] present certain empirical results for supercavitating projectiles. In particular, expression [8] relates the ratio $d_c/d_n$ to the drag coefficient, $C_D$, and the cavitation number, σ:

$$\left(\frac{d_c}{d_n}\right)^2 \approx 1.38 C_D \sigma^{-0.91} \quad [8]$$

Where:

$d_c$ is the diameter of the cavity;

$\sigma=P/(\frac{1}{2}\rho V^2)$; and

V is instantaneous velocity.

Expression [9] relates the ratio $l_c/d_n$ to the drag coefficient and the cavitation number:

$$\frac{l_c}{d_n} \approx 0.907 C_D^{0.5} \sigma^{-1.214} \quad [9]$$

Where: $l_c$ is the length of the cavity.

Figure 2:
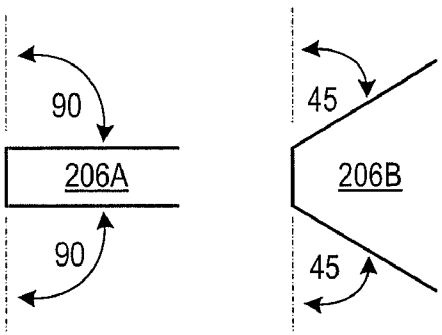
FIG. 2 depicts several shapes for the nose of the projectile of FIG. 1.

Expressions [10] through [12] relate the drag coefficient $C_D$ of the projectile to cavitation number for several nose shapes. In particular, expression [10] is for a right circular cylinder (90 degree half angle), expression [11] if for a cone with a 45 degree half angle, and expression [12] is for a cone with a 26.6 degree half angle. See, FIG. 2, wherein nose 206A has a 90 degree half angle and nose 206B has a 45 degree half angle.

$C_D\approx 0.815+0.815\sigma$ for 90 degree half angle (right circular cylinder) [10]

$$C_D \approx 0.498+0.663\sigma \text{ for 45 degree half angle} \quad [11]$$

$$C_D \approx 0.319+0.434\sigma \text{ for 26.6 degree half angle} \quad [12]$$

Figure 3:
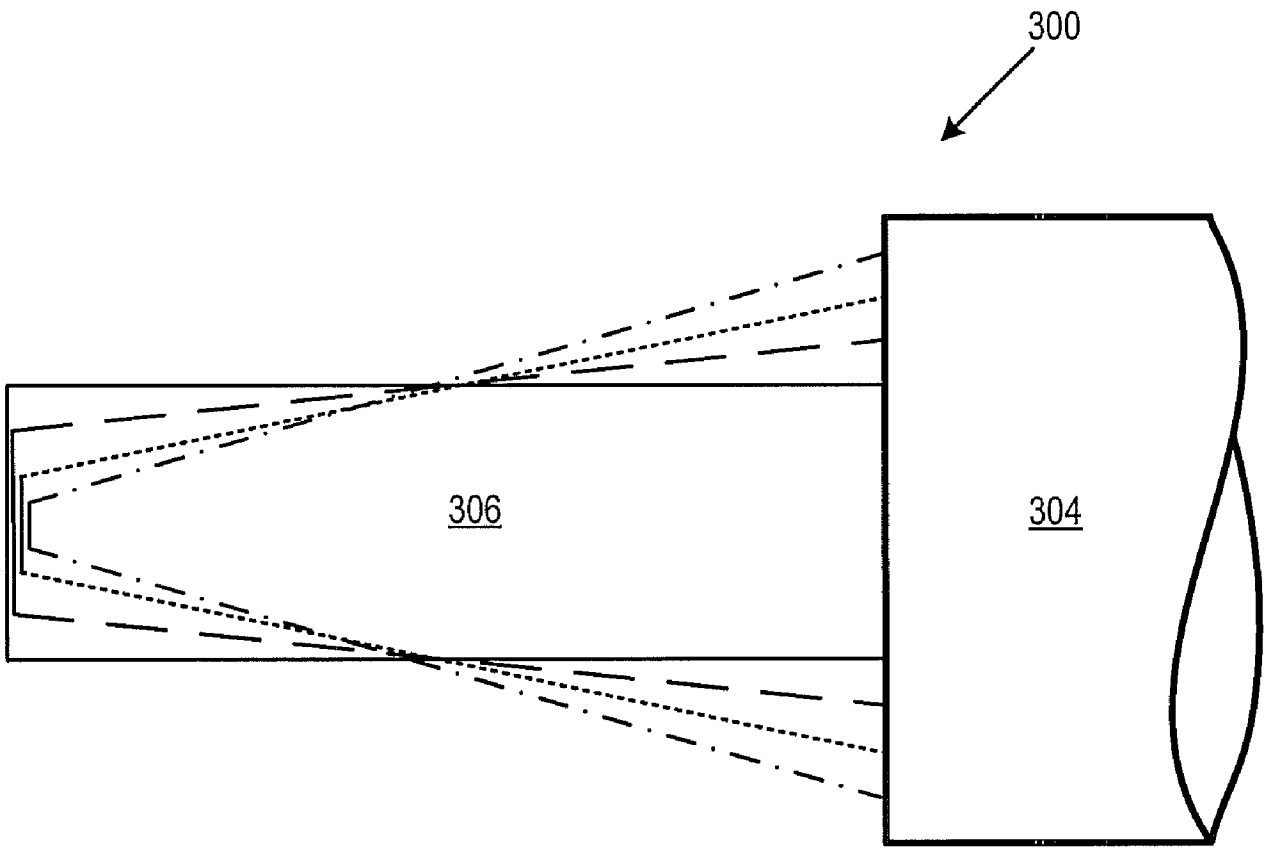
FIG. 3 depicts nose shape morphing between a right circular cone and cones of various half-angles, in accordance with the illustrative embodiment of the present invention.

Various insights of the inventor led to the inventive concept. In particular, the recognition of a relationship between cavity size/shape and nose size/shape, via the drag coefficient $C_{DO}$. And cavity size is related to supercavitating velocity $V_{sc}$, which is dependent on the diameter and length of the projectile. Drag coefficient is considered to be the independent variable and supercavitating velocity is considered to be a dependent variable. FIG. 3 depicts nose shape morphing between a right circular cone and cones of various half-angles. Doing so causes the supercavitating velocity and the range of the projectile to change. Note that the slight offset between the leading edge of the nose for different nose angles is for the sake of clarity. That is, in the embodiment depicted in FIG. 3, there is no change in the length of nose 306, as measured between the leading edge of the nose and the leading edge of body 304.

Using expressions [13] through [21] below, expression [22] provides and alternative expression to expression [1] for supercavitating range, R. In expression [22], range is a function of two independent variables: normalized instantaneous velocity, z, and nose shape, θ, (i.e., nose half-angle), and the ratio db/dn is fixed. Parameter "a," given by expression [13], is a curve-fit function of θ (based on expressions [10] through [12]). Parameters "c" and "s" which are both non-dimensionalized variables (with respect to $V_{c0}$), are given by expressions [14] and [15], respectively.

$$a \approx 1-0.763\cos^2\theta \quad [13]$$

$$c \approx 0.174552(\cos\theta)^{1/2}+1.0046 \quad [14]$$

$$s \approx \frac{\frac{d_b}{d_n} - (.7205\sin\theta + .3780)}{(.5148\sin\theta + .2367)} \quad [15]$$

$$\frac{d_c}{d_n} \approx (.5148\sin\theta + .2367)v + (.7205\sin\theta + .3780) \quad [16]$$

$$C_d = C_{d0}(a+b\sigma) \quad [17]$$

$$K_0 = \frac{1}{m}\frac{1}{2}\rho\frac{\pi}{4}d_n^2 C_{d0} \quad [18]$$

$$V_c = \sqrt{\frac{b}{a}}\,V_{c0} = cV_{c0} \quad [19]$$

$$V_{sc} = sV_{c0} \quad [20]$$

$$V_0 = zV_{c0} \quad [21]$$

$$R = \frac{1}{2K}\ln\left(\frac{V_0^2+V_c^2}{V_{sc}^2+V_c^2}\right) = \frac{1}{2K_0 a}\ln\frac{z^2+c^2}{s^2+c^2} \quad [22]$$

Rearranging expression [22] shows that the relative range ($2K_oR$) of a supercavitating projectile is proportional to:

$$2K_oR = 1/a\ \ln([z^2+c^2]/[s^2+c^2]). \quad [23]$$

Figure 4:
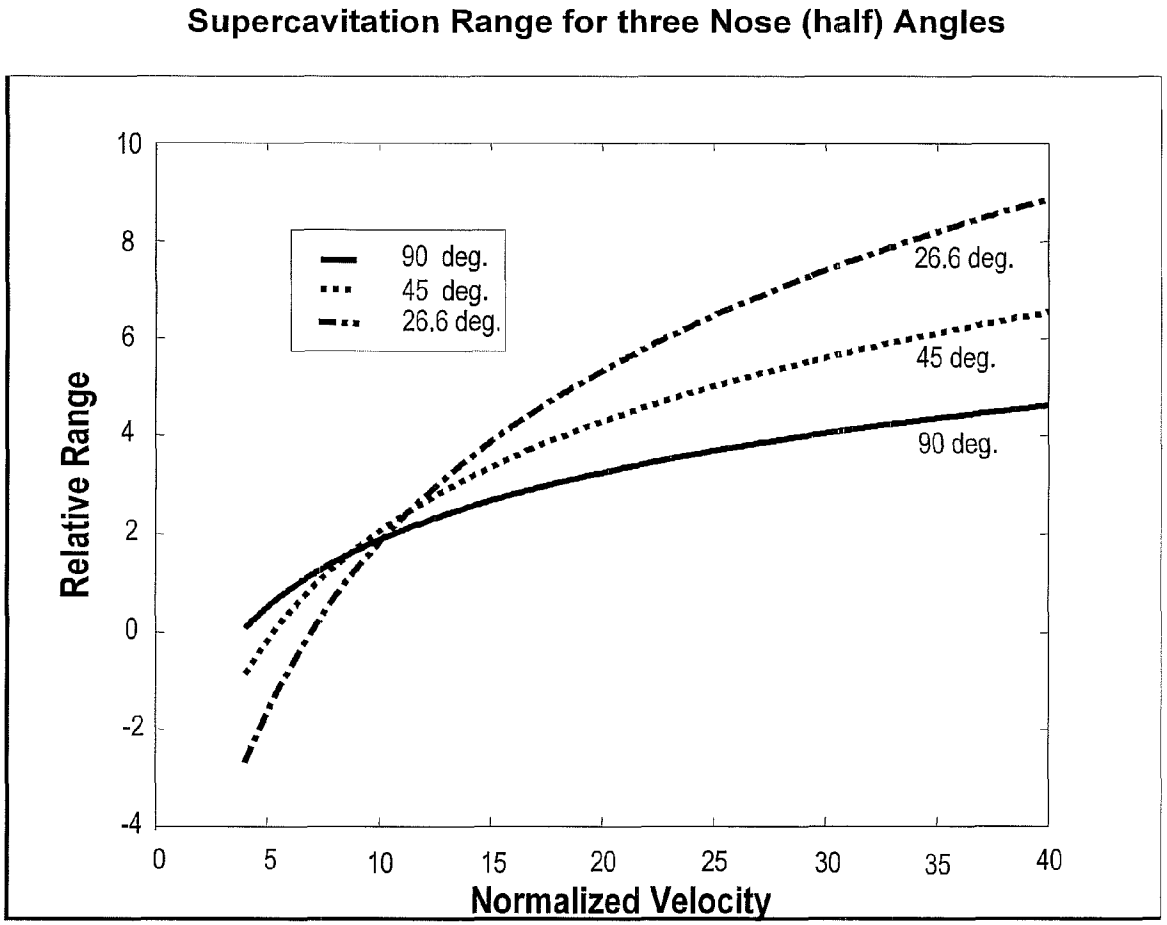
FIG. 4 depicts the relative range of a supercavitating projectile as a function of normalized velocity for three half angles of the nose of the projectile.

FIG. 4 depicts the relative range ($2K_oR$) of a supercavitating projectile as a function of normalized velocity (z) for three half angles of the nose of the projectile. It is notable that at higher values of normalized velocity, the relative range is the greatest for 26.6-degree nose and shortest for the 90-degree nose. At lower values of normalized velocity (i.e., below 10), a 90-degree nose provides the greatest range and the 26.6-degree nose provides the shortest range (of the three half angles given).

Figure 5:
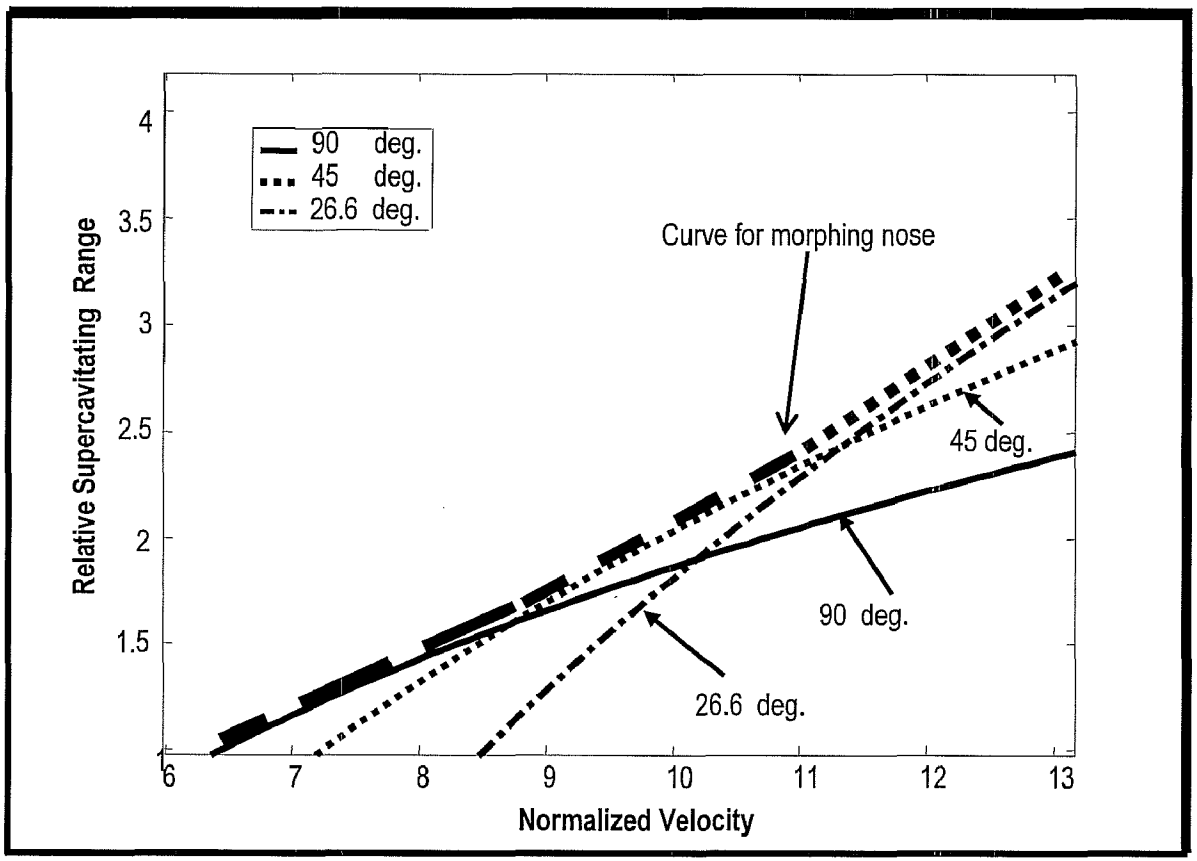
FIG. 5 depicts the region at which the curves in FIG. 4 for the three half-angles intercept.

FIG. 5 focuses on the region at which the curves for the three half-angles intercept to provide guidance for how to morph the nose for maximum range. In particular, if normalized velocity, z>11.3, the half-angle θ of the nose should be at 26.6 deg; if z is between 11.3 and 8.7, half-angle θ of the nose should be 45 deg; and if z is less than 8.7, half-angle θ of the nose should be 90 deg. Thus, benefit can be obtained even with semi-static morphing of the projectile's nose.

Figure 6:
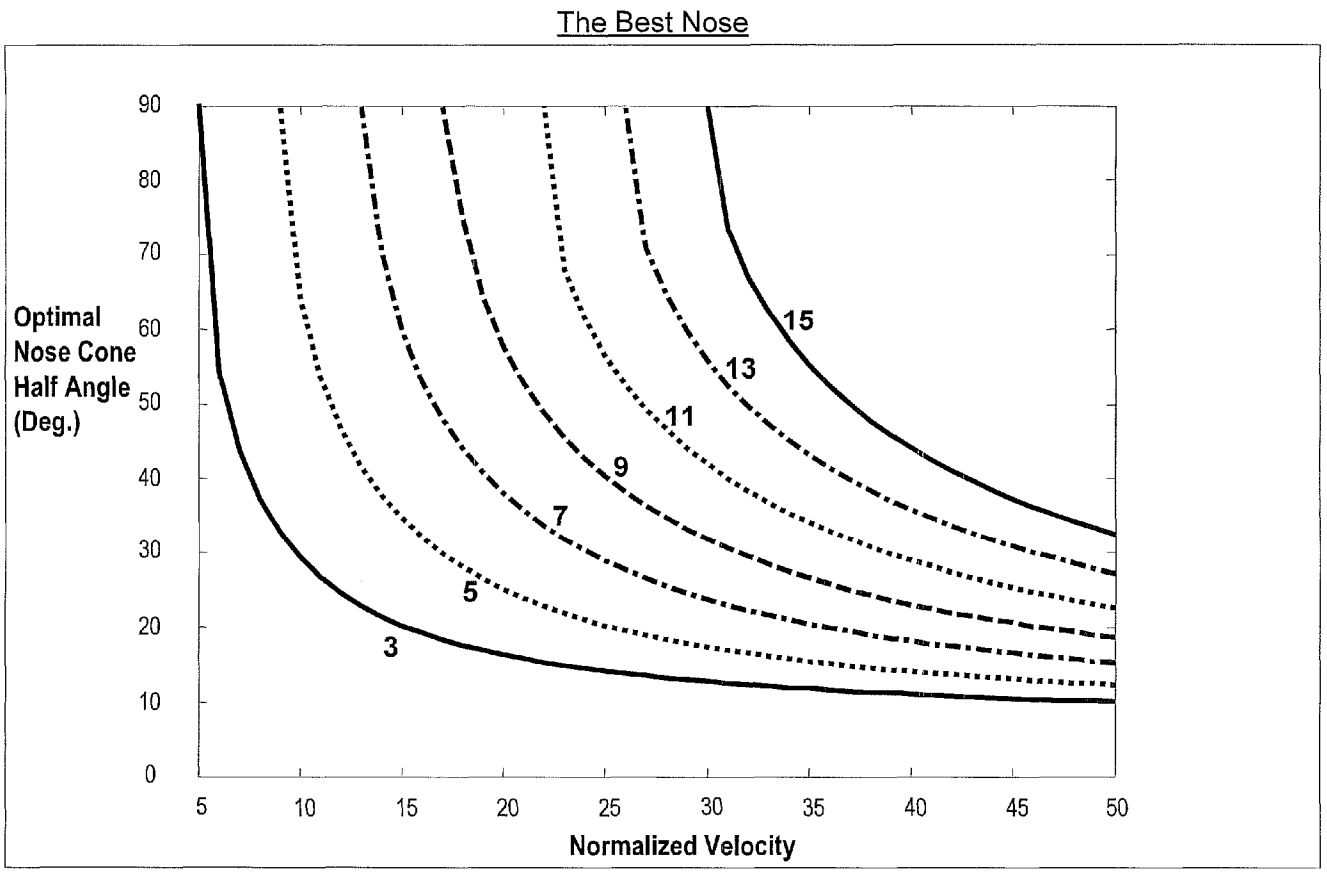
FIG. 6 depicts parametric plots, for various values of db/dn, of optimal (half) nose angles that attain the best relative ranges against normalized velocity z.

FIG. 6 depicts parametric plots, for various values of db/dn, of optimal (half) nose angles that attain the best relative ranges against normalized velocity z. The equation that pertains to this optimization problem is quite complicated, so the results were obtained using Matlab's "max" function call to identify and collect the location of the maxima.

Expression [2] for supercavitating range, R, includes variable "d," which is the ratio of body-to-nose diameter (i.e., $d=d_b/d_n$). Expression [22] for supercavitating range, R, includes a variable drag coefficient. Expression [22] includes parameter "s," given by expression [15], which is a function of θ (nose shape) and d. Combining these two equations results in expression [24], which is a function of normalized velocity, nose shape, and body-to-nose diameter ratio:

$$R = \lambda\frac{d^2}{a}\ln\frac{z^2+c^2}{s^2+c^2} \quad [24]$$

Expression [24] is "searched," rather than "solved," for maximum values of "R," the supercavitating range, over θ and d.

Table 1 below depicts the results of 'optimizing' R over both θ and d=db/dn. The best nose (θ), for each d, is curve fit as a quadratic polynomial in z (normalized velocity), with the coefficients listed in columns 2, 3, and 4. By way of example, at a "d" ($d_b/d_n$ ratio) of 7, the half angle of the "best" nose is given by the expression:

$$\theta \approx 11686.5z^2-68.6z+12.667 \quad [25]$$

TABLE 1

"Optimizing" R over both θ and d = db/dn

| COLUMN 1 D = db/dn | COLUMN 2 $Z^2$ Coeff. (θ) | COLUMN 3 $Z^1$ Coeff. (θ) | COLUMN 4 $Z^0$ Coeff. (θ) | COLUMN 5 Min Z | COLUMN 6 Max θ |
|---|---|---|---|---|---|
| 2 | 151.95 | 114.15 | 6.195 | 3.4 | 53.8 |
| 3 | 888.22 | 132.07 | 6.954 | 5.5 | 62.9 |
| 4 | 2242.91 | 127.32 | 7.923 | 7.6 | 66.8 |
| 5 | 4338.22 | 99.25 | 9.100 | 9.7 | 69.1 |
| 6 | 7512.16 | 28.06 | 10.807 | 11.7 | 72.6 |
| 7 | 11686.53 | −68.60 | 12.667 | 13.8 | 73.5 |
| 8 | 17656.12 | −239.34 | 15.429 | 15.8 | 76.2 |
| 9 | 25014.47 | −443.47 | 18.360 | 17.9 | 76.6 |
| 10 | 34623.01 | −727.72 | 22.120 | 20.0 | 77.0 |
| 11 | 46953.73 | −1107.16 | 28.821 | 22.1 | 77.3 |
| 12 | 64818.91 | −1723.41 | 34.253 | 24.1 | 79.2 |
| 13 | 86244.62 | −2441.10 | 42.373 | 26.2 | 79.4 |
| 14 | 114552.15 | −3418.40 | 53.102 | 28.3 | 79.5 |
| 15 | 152448.38 | −4757.70 | 67.404 | 30.4 | 79.6 |

Further curve fits of the coefficients (from Table 1) against parameter "d" result in the expressions [26] through [28], which provide a rough approximation for each particular coefficient as a function of "d."

$$\text{The } z^2 \text{ coefficient} \approx 104.5d^3 - 1364.9d^2 + 7808.7d - 12409 \quad [26]$$

$$\text{The } z^1 \text{ coefficient} \approx -3.954d^3 + 53.9d^2 - 265.6d + 523.6 \quad [27]$$

$$\text{The } z^0 \text{ coefficient} \approx -0.0394d^3 - 0.5306d^2 + 3.5214d + 0.3596 \quad [28]$$

The combination of expressions [26] through [28] therefore provides an expression for the best nose as a function of "d" for maximizing supercavitating range, as per expression [29]:

$$\theta \approx \text{expression [26]} \times z^2 + \text{expression [27]} \times z^1 + \text{expression [28]} \times z^0 \quad [29]$$

Columns 5 and 6 of Table 1 reveal that for best nose design, there is a quick and dramatic transition of nose shape θ (given as a cone half angle) as a function of normalized velocity. In particular, the optimum value of nose shape provided in column 6 transitions to a right circular cylinder (i.e., 90 degrees) when normalized velocity z is less than the value given in column 5. A curve fit for col. 6 results in expression [30].

$$\theta \approx 0.0233d^3 - 0.8d^2 + 9.48d + 39.3 \quad [30]$$

Figure 7:
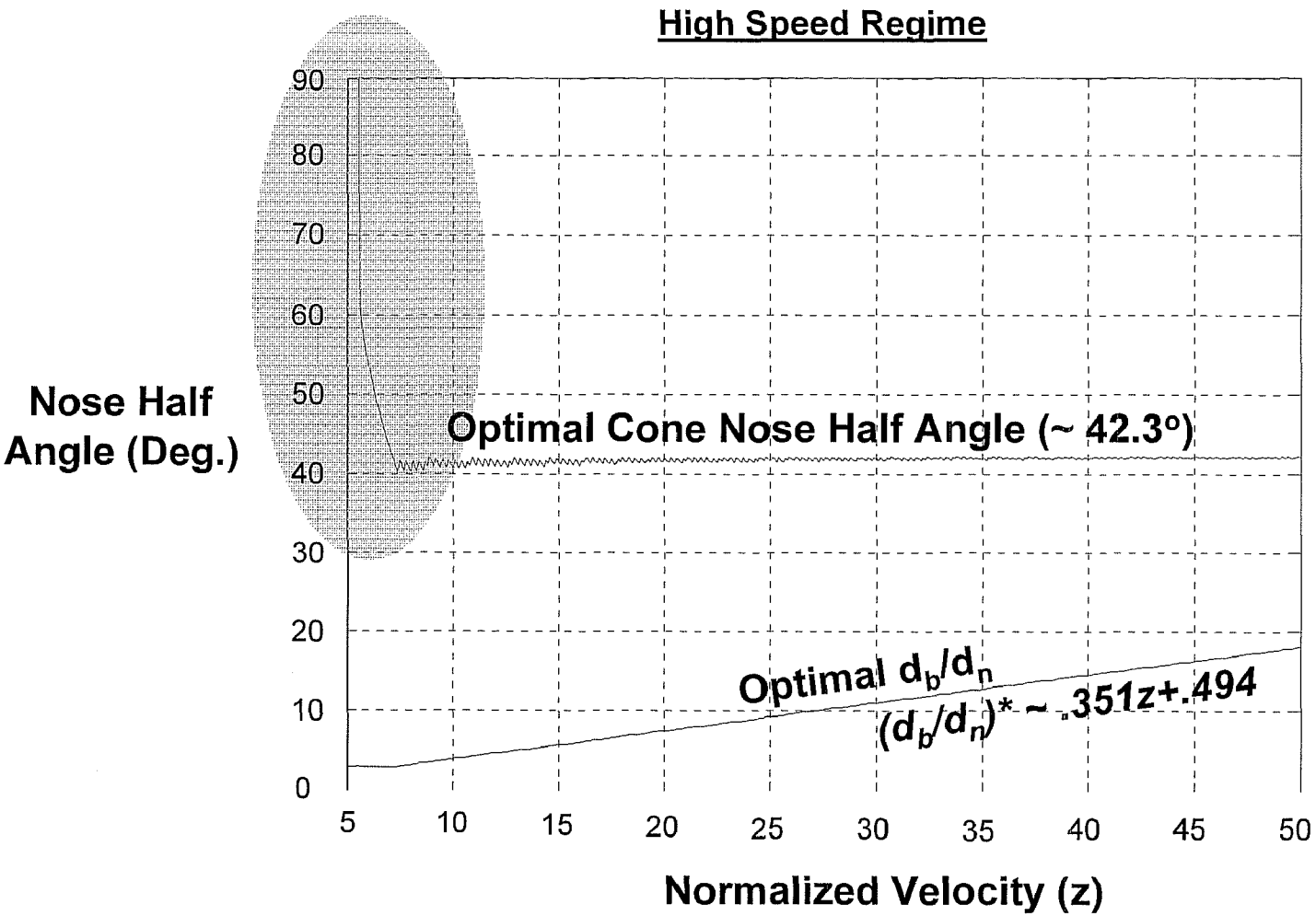
FIG. 7 depicts the optimal half angle (θ) of the nose and the optimal $d_b/d_n$ as a function of normalized velocity z.

FIG. 7 depicts, as two curves, the optimal half angle (θ) of the nose and the optimal $d_b/d_n$ as a function of normalized velocity z. For large values of z, the optimal half angle for the nose is fairly constant at about 42.3 deg and the optimal db/dn is linear with normalized velocity z. The trend is maintained until normalized velocity slows to about 7.5.

Figure 8:
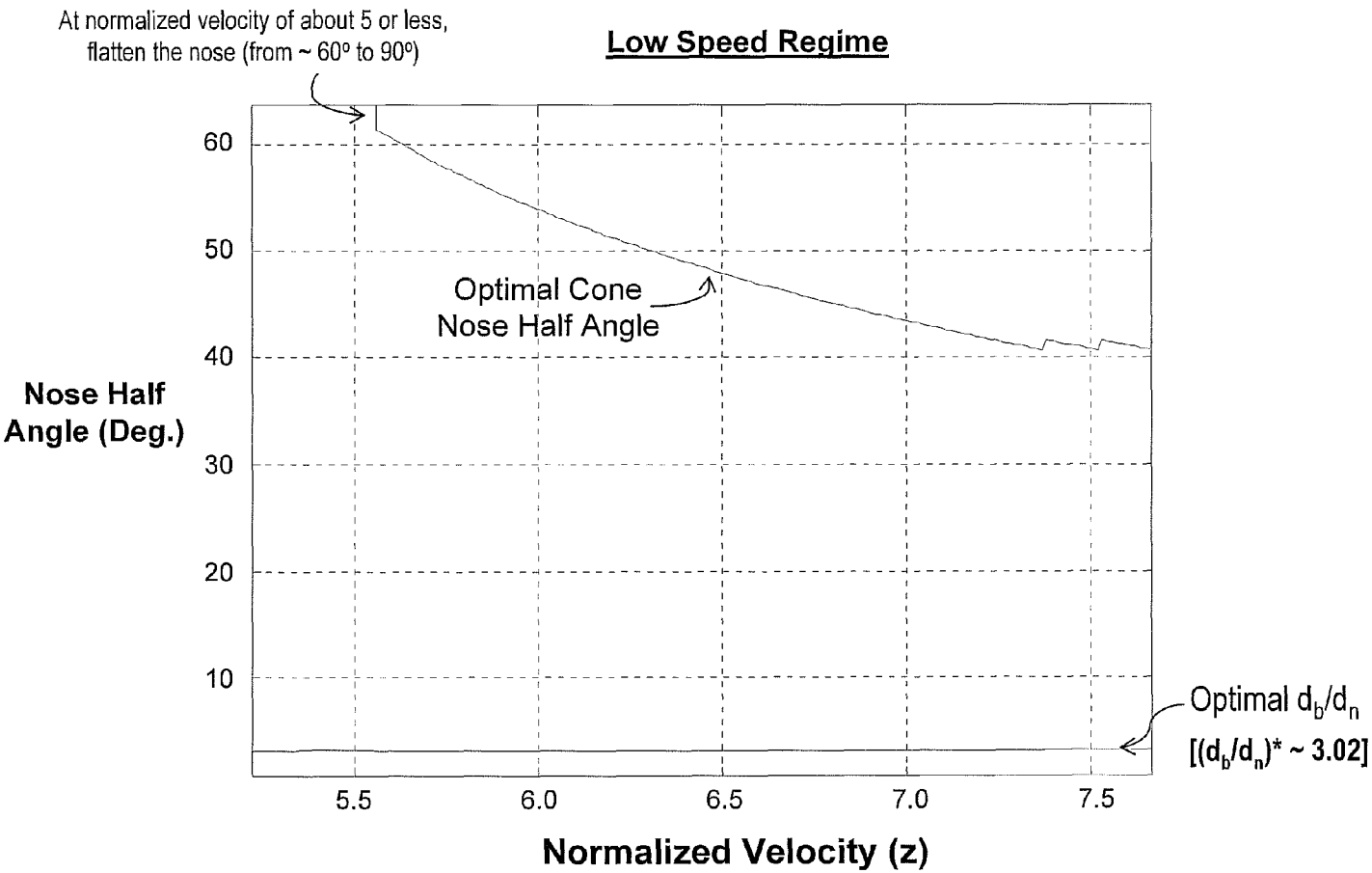
FIG. 8 depicts details of the transition zone from FIG. 8.

FIG. 8 depicts details of the transition zone from FIG. 7, where, as normalized velocity z decreases below 7.5, the best half angle for the nose steadily increases and the optimal $d_b/d_n$ is constant at about 3. As normalized velocity z decreases to about 5.6, the best half angle for the nose increases to 90 deg (i.e., a flat, right circular cylindrical nose).

Expressions [31] and [32] provide a piece-wise curve fit for the range of normalized velocity depicted in FIG. 8.

$$\theta \approx 5.92z^2 - 85.46z + 353.61 \text{ for: } 5.5 \leqq z \leqq 6.4 \quad [31]$$

$$\theta \approx 2.06z^2 - 36.92z + 200.82 \text{ for: } 6.4 \leqq z \leqq 7.3 \quad [32]$$

Figure 9:
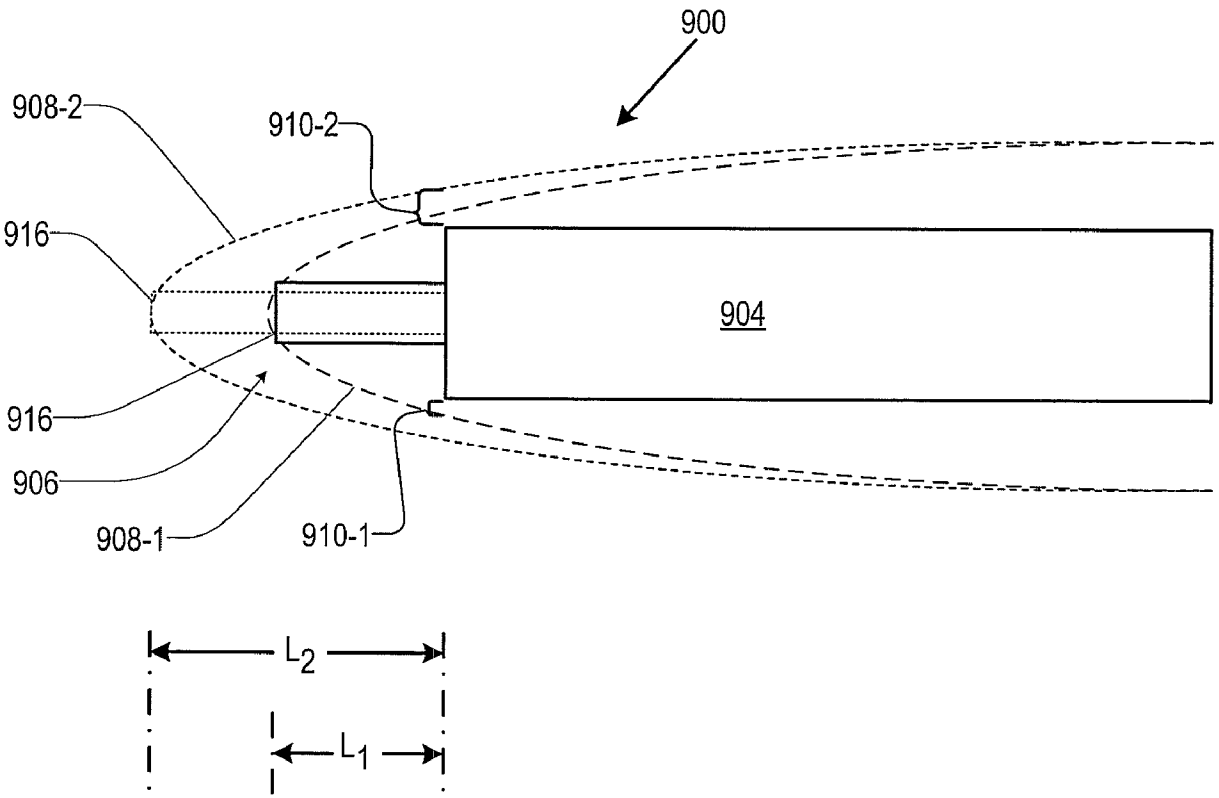
FIG. 9 depicts an extendable/retractable nose in accordance with the illustrative embodiment of the present invention.

Nose Length. FIG. 9 depicts projectile 900 in supercavitating operation. Projectile 900 includes body 904 and extendable/retractable nose 906. In the embodiment that is depicted in FIG. 9, the nose is movable between a retracted state and an extended state. In the retracted state, cavitator 916 (at the leading edge of nose 906) extends distance $L_1$ forward of body 904. In the extended state, cavitator 916 extends distance $L_2$ forward of body 904.

Cavity 908-1 results when nose 906 is in the retracted state and cavity 908-2 results when nose 906 is in the extended state. The shape and size of cavities 908-1 and 908-2 are substantially the same. But as a consequence of the changed distance between cavitator 916 and body 904 in the two states, the relative position of body 904 within the two cavities 908-1 and 908-2 changes. That is, the leading edge of cavity 908-2 is further from body 904 than the leading edge of cavity 908-1 is from body 904. In fact, since the cavity essentially begins at the cavitator, the distances between the leading edge of cavity 908-2 and body 904 is $L_2$ and the distance between the leading edge of cavity 908-1 and body 904 is about $L_1$. Since the cavity begins further from body 904 when nose 906 is in the extended state, but the cavity size and shape does not change, body 904 of the projectile is effectively shifted more toward the wider region of the elliptical-shape cavity. As a result of this change in relative position within the cavity, clearance 910-2 between the edge of cavity 908-2 and body 904 is greater than clearance 910-1 between the edge of cavity 908-1 and body 904.

The cavity formed via supercavitation is generally ellipsoid; therefore, the cavity is generally narrowest near the antipodal points along the main axis. The present inventor recognized that lengthening the nose of the projectile will have the effect of shifting the cavity "forward" relative to the main body of the projectile, so that the widest parts of the projectile (e.g., radially-extending appendages such as canards, etc) will tend to be positioned within the wider parts of the cavity. This will decrease the likelihood of cavity clipping and the consequential loss of supercavitation, whether due to the presence of radially-extending appendages or during acceleration from rest.

Any of a variety of arrangements can be used to extend/retract nose 906. For example, in some embodiments, nose 906 comprises a plurality of nested cylinders (in the manner of a spy-glass), wherein the cylinders are actuated to extend or retract via appropriate links and any conveniently-applied motive force (e.g., electrically, hydraulic, magnetic, pneumatic, etc.). In some other embodiments, nose 906 is a single cylinder or cone that actuated to move into or out of body 904, effectively changing the length of nose 906.

In some embodiments, nose 906 is capable of changing shape, as previously described, as well as its length. In conjunction with the present disclosure, those skilled in the art will be capable of designing and building a nose that is capable of morphing (e.g., changing the cone half-angle) as well as changing its length.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A projectile that is capable of moving underwater in a supercavitating mode, wherein the projectile comprises:
- a substantially cylindrical body; and
- a morphable nose attached to an end of the body, wherein the nose:
  - (a) has a blunt end that is physically adapted for generating a projectile-encompassing air cavity; and
  - (b) has a shape that morphs between a frustum of a cone and a right circular cylinder, as the projectile moves underwater, by varying the orientation of the side of the nose, wherein, when a half angle of the nose is equal to ninety degrees, the shape is a right circular cylinder and when a half angle of the nose is less than ninety degrees, the shape is a frustum of a cone.

2. The projectile of claim 1 wherein the orientation of the side of the nose is varied as a function of the supercavitating speed of the projectile.

3. The projectile of claim 1 wherein the half angle of the nose is relatively smaller at relatively higher supercavitating speeds of the projectile and relatively larger at relatively lower supercavitating speeds of the projectile.

4. The projectile of claim 1 wherein the morphable nose is further physically adapted to change a distance between the blunt end of the nose and a leading edge of the cylindrical body.

5. The projectile of claim 4 further comprising an actuation system for extending and retracting the morphable nose.

6. The projectile of claim 5 wherein the actuation system comprises a stepper motor.

7. The projectile of claim 1 wherein the nose comprises a plurality of nested cylinders.

8. The projectile of claim 1 wherein the half angle of the nose is 90 degrees when a normalized velocity of the projectile is less than 8.7.

9. The projectile of claim 1 wherein the half angle of the nose is 45 degrees when a normalized velocity of the projectile is in a range of 8.7 to 11.3.

10. The projectile of claim 1 wherein the half angle of the nose is 26.6 degrees when a normalized velocity of the projectile is greater than 11.3.

11. The projectile of claim 1 wherein the half angle θ of the nose is given by the expression:

$$\theta=0.0233d^3-0.8d^2+9.48d+39.3,$$

wherein $d=d_b/d_n$;

$d_b$=diameter of the body of the projectile; and $d_n$=diameter of the nose of the projectile.

12. The projectile of claim 1 wherein the half angle θ of the nose is given by the expression $\theta=5.92z^2-85.46z+353.61$ when a normalized velocity of the projectile is in a range of 5.5 to 6.4.

13. The projectile of claim 1 wherein the half angle θ of the nose is given by the expression $\theta=2.06z^2-36.92z+200.82$ when a normalized velocity of the projectile is in a range of 6.4 to 7.3.

14. A projectile that is capable of moving underwater in a supercavitating mode, wherein the projectile comprises:

a substantially cylindrical body; and a morphable nose attached to an end of the body, wherein the nose:

(a) has a blunt end that is physically adapted for generating a projectile-encompassing air cavity; and (b) comprises a plurality of cylindrical segments that vary in diameter, each having a different diameter, so that relatively smaller cylindrical segments are fully nestable within relatively larger cylindrical segments; and an actuation system, wherein the actuation system is operatively coupled to the morphable nose to extend and retract the cylindrical segments, and wherein an external surface of the morphable nose has a stepped profile dictated by the cylindrical segments that are extended by the actuation system, wherein the stepped profile results in step changes in a diameter of the morphable nose, the step changes causing a diameter of the morphable nose to decrease towards a tip thereof.

15. The projectile of claim 14 wherein the actuation system comprises a stepper motor.

* * * * *